US006701122B2

(12) United States Patent
Maeshima et al.

(10) Patent No.: US 6,701,122 B2
(45) Date of Patent: Mar. 2, 2004

(54) CLEANING DEVICE AND IMAGE FORMING APPARATUS HAVING IT

(75) Inventors: Masanobu Maeshima, Osaka (JP); Naoki Yamane, Osaka (JP); Hiromichi Ninomiya, Kyoto (JP)

(73) Assignees: Kyocera Mita Corporation, Osaka (JP); Kyocera Corporation, Kyoto (JP)

( * ) Notice: Subject to any disclaimer, the term of this patent is extended or adjusted under 35 U.S.C. 154(b) by 6 days.

(21) Appl. No.: 10/231,016

(22) Filed: Aug. 30, 2002

(65) Prior Publication Data

US 2003/0053831 A1 Mar. 20, 2003

(30) Foreign Application Priority Data

Sep. 20, 2001 (JP) ..... 2001-286251

(51) Int. Cl.[7] ..... G03G 21/00
(52) U.S. Cl. ..... 399/349; 399/350; 399/357
(58) Field of Search ..... 399/71, 343, 347, 399/349, 350, 357, 358; 15/1.51

(56) References Cited

U.S. PATENT DOCUMENTS 4,910,560 A * 3/1990 Kanada ..... 399/343
4,972,233 A * 11/1990 Yamazaki et al. ..... 399/347
4,974,030 A * 11/1990 Tokunaga et al. ..... 399/347

* cited by examiner

*Primary Examiner*—Hoan Tran
(74) *Attorney, Agent, or Firm*—Smith, Gambrell & Russell, LLP

(57) ABSTRACT

A cleaning device including a housing disposed above a photoconductor drum and having an opening portion open downward toward the circumferential surface of the photoconductor drum, a cleaning blade disposed in the housing so as to be located in the opening portion downstream in the direction of rotation of the photoconductor drum, and a cleaning roller disposed in the housing so as to be located in the opening portion upstream from the cleaning blade in the direction of rotation of the photoconductor drum; and an image forming apparatus equipped with the cleaning device. In the housing of the cleaning device, a spiral roller for letting out a toner recovered into the housing is disposed above the cleaning blade. A partition wall is disposed between the cleaning blade and the spiral roller, and a toner movement space for moving the toner recovered into the housing is formed between the front end of the partition wall and the circumferential surface of the cleaning roller.

28 Claims, 4 Drawing Sheets

CLEANING DEVICE AND IMAGE FORMING APPARATUS HAVING IT

FIELD OF THE INVENTION

This invention relates to a cleaning device for removing an untransferred toner remaining on the circumferential surface of a photoconductor drum, and more specifically, to a cleaning device disposed above the photoconductor drum, and an image forming apparatus equipped with the cleaning device.

DESCRIPTION OF THE PRIOR ART

In recent years, there have been increases in electrostatic copiers of an in-body paper delivery type in which a paper stack space is provided in a region between image forming means, including a photoconductor drum, and document exposure/image reading means disposed above the image forming means in the body of an image forming apparatus to achieve compactness of the entire apparatus. In such a copier, paper is transported vertically upwardly from a paper feed cassette or a manual paper feed tray disposed below the image forming means. While the paper transported vertically upwardly is passing through a transfer zone disposed beside the photoconductor drum, a toner is transferred to the paper by transfer means. The paper having the toner transferred thereto is transported, unchanged, vertically upwardly, and then passed beside a fixing device. During this passage, the toner transferred to the paper is fixed onto the paper. The paper bearing the fixed toner is transported vertically upwardly, then changed in the direction of transport, and transported in a horizontal direction. Finally, the paper is delivered to a paper receiving tray in the paper stack space. The untransferred toner, which has not been transferred onto the paper, but has remained on the circumferential surface of the photoconductor drum, is removed by a cleaning device provided downstream from the transfer zone in the direction of rotation of the photoconductor drum. In such a copier of the in-body paper delivery type, the paper is transported vertically upwardly beside the photoconductor drum. Thus, there is no choice but to provide the cleaning device above the photoconductor drum. As a result, the cleaning device is configured to have a lower end portion downwardly opening toward the circumferential surface of the photoconductor drum.

Of the copiers of the in-body paper delivery type, those operating at a low speed have been predominant conventionally, but have recently been replaced by high speed ones gradually. With this technical background, the copiers in the above-mentioned configuration are increasing the use of a low temperature fixing toner, an a-Si(amorphous silicon)-based photoconductor drum, or a high sensitivity OPC (Organic Photoconductor) photoconductor drum.

When the toner remaining on the circumferential surface of the photoconductor drum is removed using a cleaning blade, additives detached from the toner may deposit on the circumferential surface of the photoconductor drum, and may be unremovable by cleaning. If the additives remain on the circumferential surface of the photoconductor drum, the remaining additives form cores, around which the poorly cleanable toner grows, forming masses. Every time the resulting masses slip beside the cleaning blade, they fuse, leaving streaky toner deposits on the circumferential surface of the photoconductor drum. Since a fresh toner is developed on the toner deposits, copy smudges resembling black spots corresponding to the toner deposits appear on the surface of the paper which is a copy. Particularly when the low temperature fixing toner is used, this tendency is marked. With the speeding of the in-body paper delivery type copier, a demand is becoming intense for a solution to this problem. Furthermore, when a magnetic toner is used, the following facts are presented: First, a magnetic powder contained in the magnetic toner, such as magnetite, becomes a causative substance, like the aforementioned detached additives, for the toner deposits on the circumferential surface of the photoconductor drum. Secondly, if a high copying speed is intended, a binder resin needs to have the property of fixing at an even lower temperature, in order to obtain fixing performance comparable to that of a nonmagnetic toner with the use of the magnetic toner. For these reasons, black spot-like copy smudges may occur noticeably. Even in light of the difference in weight between the magnetic toner and the nonmagnetic toner, if the copying speed of the in-body paper delivery type copier is increased, black spot-like smudges of the copy due to the deposition of the toner is even more marked, posing a problem to be solved.

Furthermore, the photoconductor drum itself poses the following problem: When an a-Si-based photoconductor drum is used, products of electric discharge, such as $NO_x$ and $SO_x$, are generated by a main charger, a transfer charger, and a static eliminator disposed around the photoconductor drum. When these discharge products are exposed to a high humidity environment while depositing on the circumferential surface of the photoconductor drum, they adsorb moisture in the air to disturb an electrostatic latent image on the circumferential surface of the photoconductor drum, thereby causing image distortion. In addition, ozone which develops from the chargers and the static eliminator oxidizes and deteriorates the circumferential surface of the photoconductor drum, causing a tendency toward aggravation of image distortion. If a photoconductor drum other than the a-Si-based photoconductor drum, for example, the OPC photoconductor drum, is used, on the other hand, the toner undergoes filming on the circumferential surface of the photoconductor drum. As a result, photosensitivity and chargeability decline, so that fog in non-image areas or a decrease in image density tends to occur. Filming of the toner refers to the phenomenon that during repeated image formation and cleaning for long periods of time, the toner particles pressed against, slid over and rubbed against the circumferential surface of the photoconductor drum by the cleaning blade are deformed plastically and fused in a film form onto the circumferential surface.

To deal with the foregoing problems, it is necessary to polish the circumferential surface of the photoconductor drum aggressively, and always maintain the circumferential surface of the photoconductor drum in a clean state. For this purpose, a cleaning roller composed of an elastic material such as urethane rubber is provided upstream from the cleaning blade. This cleaning roller is driven so as to be rotationally moved in the same direction as the photoconductor drum at a peripheral speed higher than that of the photoconductor drum at the site of its pressurized contact with the photoconductor drum. Alternatively, the cleaning roller is rotated in a manner following the photoconductor drum. By so doing, the cleaning roller is slid over and rubbed against the circumferential surface of the photoconductor drum to polish it. More concretely, the cleaning roller shows its own action of cleaning, and in addition, polishes the circumferential surface of the photoconductor drum by sliding on and rubbing against it via the toner and the toner additives remaining on the circumferential surface of the photoconductor drum, thereby keeping the circumferential surface of the photoconductor drum always clean. Consequently, image distortion, toner filming, or toner deposition on the circumferential surface of the photoconductor drum is prevented.

As described above, it is desirable in the in-body paper delivery type copier to provide the cleaning roller in the cleaning device. However, the provision of the cleaning roller in addition to the cleaning blade and the toner outletting spiral means requires a considerable proportion of the space around the photoconductor drum, inducing upsizing of the entire copier. An alternative measure would be to thrust the cleaning blade in the axial direction of the photoconductor drum, thereby minimizing the slipping escape of the deposited toner from the cleaning blade. Even if this measure is taken, however, image distortion and toner filming cannot be prevented effectively, and seal between the cleaning blade and the circumferential surface of the photoconductor drum is decreased, whereupon the toner falls toward the photoconductor drum, causing the risks of copy smudges and dirt inside the apparatus. Besides, because of the thrust of the cleaning blade, the edge face of the cleaning blade is liable to damage, disadvantaging the long life of the apparatus.

A further problem with the prior art exists. That is, when an ordinary cleaning device is disposed, unchanged, above the photoconductor drum, the toner outletting spiral means is provided upstream from the cleaning blade in the direction of rotation of the photoconductor drum. Thus, the toner recovered is rendered stagnant above the cleaning blade by the transport action of the photoconductor drum itself, whereby the toner transport ability of the toner outletting spiral means fails to work effectively. As a result, toner agglomeration, toner blocking or the like occurs, so that the action of outletting the recovered toner is itself insufficient. In the worst case, there may be a serious trouble, such as the toner outletting spiral means becoming locked.

SUMMARY OF THE INVENTION

An object of the present invention is to provide a novel cleaning device, which accommodates a cleaning blade, a cleaning roller and toner outletting spiral means compactly and which can downsize the entire structure, and more specifically, a novel cleaning device disposed above a photoconductor drum for removing an untransferred toner remaining on the circumferential surface of the photoconductor drum; and a novel image forming apparatus equipped with the cleaning device.

Another object of the present invention is to provide a novel cleaning device which prevents the occurrence of toner agglomeration or toner blocking until the recovered toner is let out, and which enables the recovered toner to be transported and let out smoothly and promptly, and more specifically, a novel cleaning device disposed above the photoconductor drum for removing an untransferred toner remaining on the circumferential surface of the photoconductor drum; and a novel image forming apparatus equipped with the cleaning device.

Yet another object of the present invention is to provide a novel cleaning device which enables the recovered toner to be promptly transported toward the outside and let out without being leaked to the outside, and more specifically, a novel cleaning device disposed above the photoconductor drum for removing an untransferred toner remaining on the circumferential surface of the photoconductor drum; and a novel image forming apparatus equipped with the cleaning device.

A further object of the present invention is to provide a novel image forming apparatus of an in-body paper delivery type which ensures satisfactory image formation and which permits a high copying speed.

A still further object of the present invention is to provide a novel image forming apparatus of an in-body paper delivery type which prevents image distortion, toner filming and toner deposition occurring on the circumferential surface of the photoconductor drum, and which enables a maintenance cycle to be extended.

According to an aspect of the present invention, there is provided a cleaning device comprising:

- a housing disposed above a photoconductor drum and having an opening portion open downward toward a circumferential surface of the photoconductor drum;
- a cleaning blade disposed in the housing so as to be located in the opening portion downstream in a direction of rotation of the photoconductor drum; and
- a cleaning roller disposed in the housing so as to be located in the opening portion upstream from the cleaning blade in the direction of rotation of the photoconductor drum, and wherein, in the housing,
- toner outletting spiral means for letting out a toner recovered into the housing is disposed above the cleaning blade;
- a partition wall is disposed between the cleaning blade and the toner outletting spiral means; and
- a toner movement space for moving the toner recovered into the housing is formed between a front end of the partition wall and a circumferential surface of the cleaning roller.

Preferably, when a rotation region of the toner outletting spiral means is viewed in a vertical direction, the partition wall extends out from a downstream end of the rotation region toward an upstream end of the rotation region in the direction of rotation of the photoconductor drum; and when the rotation region is viewed in the vertical direction, an effective length of shielding of the rotation region by the partition wall is 30% or more of a diameter of the rotation region.

Preferably, the front end of the partition wall is disposed nearly vertically below a center of rotation of the toner outletting spiral means.

Preferably, the horizontal distance at which the front end of the partition wall and the circumferential surface of the cleaning roller maximally approach each other is 2 mm or more.

Preferably, the circumferential surface of the cleaning roller rotationally moves in the same direction as the circumferential surface of the photoconductor drum at a site of pressurized contact between the circumferential surface of the cleaning roller and the circumferential surface of the photoconductor drum; a scraper is disposed within the housing; and a front end portion of the scraper is brought into pressurized contact with the circumferential surface of the cleaning roller at a position downstream from the site of pressurized contact between the circumferential surface of the cleaning roller and the circumferential surface of the photoconductor drum in a direction of rotation of the cleaning roller, with a front end of the scraper being directed in a direction opposite to the direction of rotation of the cleaning roller.

Preferably, the scraper is disposed so as to be capable of scraping off the toner deposited on the circumferential surface of the cleaning roller either to a gap between the cleaning roller and the toner outletting spiral means, or toward a rotation region of the toner outletting spiral means.

Preferably, the distance at which the circumferential surface of the cleaning roller and a rotation region of the toner outletting spiral means maximally approach each other is 3 mm or less.

Preferably, the cleaning roller functions as a polishing roller, because the circumferential surface of the cleaning roller makes pressurized contact with the circumferential surface of the photoconductor drum via the toner.

According to another aspect of the present invention, there is provided a cleaning device comprising:

a housing disposed above a photoconductor drum and having an opening portion open downward toward a circumferential surface of the photoconductor drum;

a cleaning blade disposed in the housing so as to be located in the opening portion downstream in a direction of rotation of the photoconductor drum; and a cleaning roller disposed in the housing so as to be located in the opening portion upstream from the cleaning blade in the direction of rotation of the photoconductor drum, and wherein toner outletting spiral means for letting out a toner recovered into the housing is disposed above the cleaning blade in the housing;

a scraper is disposed within the housing;

a circumferential surface of the cleaning roller rotationally moves in the same direction as the circumferential surface of the photoconductor drum at a site of pressurized contact between the circumferential surface of the cleaning roller and the circumferential surface of the photoconductor drum;

a front end portion of the scraper is brought into pressurized contact with the circumferential surface of the cleaning roller at a position downstream from the site of pressurized contact between the circumferential surface of the cleaning roller and the circumferential surface of the photoconductor drum in a direction of rotation of the cleaning roller, with a front end of the scraper being directed in a direction opposite to the direction of rotation of the cleaning roller; and the scraper is disposed so as to be capable of scraping off the toner deposited on the circumferential surface of the cleaning roller either to a gap between the cleaning roller and the toner outletting spiral means, or toward a rotation region of the toner outletting spiral means.

Preferably, in the housing, a partition wall is disposed between the cleaning blade and the toner outletting spiral means; and a toner movement space for moving the toner recovered into the housing is formed between a front end of the partition wall and the circumferential surface of the cleaning roller.

Preferably, the cleaning roller functions as a polishing roller, because the circumferential surface of the cleaning roller makes pressurized contact with the circumferential surface of the photoconductor drum via the toner.

According to still another aspect of the present invention, there is provided an image forming apparatus comprising:

a photoconductor drum; and a cleaning device for removing a toner remaining on a circumferential surface of the photoconductor drum, the cleaning device comprising:

a housing disposed above a photoconductor drum and having an opening portion open downward toward the circumferential surface of the photoconductor drum;

a cleaning blade disposed in the housing so as to be located in the opening portion downstream in a direction of rotation of the photoconductor drum; and a cleaning roller disposed in the housing so as to be located in the opening portion upstream from the cleaning blade in the direction of rotation of the photoconductor drum, and wherein, in the housing, toner outletting spiral means for letting out the toner recovered into the housing is disposed above the cleaning blade;

a partition wall is disposed between the cleaning blade and the toner outletting spiral means; and a toner movement space for moving the toner recovered into the housing is formed between a front end of the partition wall and a circumferential surface of the cleaning roller.

Preferably, when a rotation region of the toner outletting spiral means is viewed in a vertical direction, the partition wall extends out from a downstream end of the rotation region toward an upstream end of the rotation region in the direction of rotation of the photoconductor drum; and when the rotation region is viewed in the vertical direction, an effective length of shielding of the rotation region by the partition wall is 30% or more of a diameter of the rotation region.

Preferably, the front end of the partition wall is disposed nearly vertically below a center of rotation of the toner outletting spiral means.

Preferably, the horizontal distance at which the front end of the partition wall and the circumferential surface of the cleaning roller maximally approach each other is 2 mm or more.

Preferably, the circumferential surface of the cleaning roller rotationally moves in the same direction as the circumferential surface of the photoconductor drum at a site of pressurized contact between the circumferential surface of the cleaning roller and the circumferential surface of the photoconductor drum; a scraper is disposed within the housing; and a front end portion of the scraper is brought into pressurized contact with the circumferential surface of the cleaning roller at a position downstream from the site of pressurized contact between the circumferential surface of the cleaning roller and the circumferential surface of the photoconductor drum in a direction of rotation of the cleaning roller, with a front end of the scraper being directed in a direction opposite to the direction of rotation of the cleaning roller.

Preferably, the scraper is disposed so as to be capable of scraping off the toner deposited on the circumferential surface of the cleaning roller either to a gap between the cleaning roller and the toner outletting spiral means, or toward a rotation region of the toner outletting spiral means.

Preferably, the distance at which the circumferential surface of the cleaning roller and a rotation region of the toner outletting spiral means maximally approach each other is 3 mm or less.

Preferably, the cleaning roller functions as a polishing roller, because the circumferential surface of the cleaning roller makes pressurized contact with the circumferential surface of the photoconductor drum via the toner.

Preferably, the image forming apparatus comprises an image forming apparatus body; image forming means disposed in the body and including the photoconductor drum and the cleaning device; document exposure/image reading means disposed within an upper end portion of the body and above the image forming means; a paper stack space portion disposed in a region between the image forming means and the document exposure/image reading means in the body; and a paper transport passage extending in a vertical direction beside the photoconductor drum and adapted to guide fed paper to the paper stack space portion.

Preferably, the photoconductor drum comprises an a-Si-based photoconductor drum, and the peripheral speed of the cleaning roller is greater than the peripheral speed of the photoconductor drum.

Preferably, the toner comprises a magnetic toner.

According to a further aspect of the present invention, there is provided an image forming apparatus comprising:

a photoconductor drum; and a cleaning device for removing a toner remaining on a circumferential surface of the photoconductor drum, the cleaning device comprising:

a housing disposed above the photoconductor drum and having an opening portion open downward toward the circumferential surface of the photoconductor drum;

a cleaning blade disposed in the housing so as to be located in the opening portion downstream in a direction of rotation of the photoconductor drum; and a cleaning roller disposed in the housing so as to be located in the opening portion upstream from the cleaning blade in the direction of rotation of the photoconductor drum, and wherein toner outletting spiral means for letting out the toner recovered into the housing is disposed above the cleaning blade in the housing;

a scraper is disposed within the housing;

a circumferential surface of the cleaning roller rotationally moves in the same direction as the circumferential surface of the photoconductor drum at a site of pressurized contact between the circumferential surface of the cleaning roller and the circumferential surface of the photoconductor drum;

a front end portion of the scraper is brought into pressurized contact with the circumferential surface of the cleaning roller at a position downstream from the site of pressurized contact between the circumferential surface of the cleaning roller and the circumferential surface of the photoconductor drum in a direction of rotation of the cleaning roller, with a front end of the scraper being directed in a direction opposite to the direction of rotation of the cleaning roller; and the scraper is disposed so as to be capable of scraping off the toner deposited on the circumferential surface of the cleaning roller either to a gap between the cleaning roller and the toner outletting spiral means, or toward a rotation region of the toner outletting spiral means.

Preferably, in the housing, a partition wall is disposed between the cleaning blade and the toner outletting spiral means; and a toner movement space for moving the toner recovered into the housing is formed between a front end of the partition wall and the circumferential surface of the cleaning roller.

Preferably, the cleaning roller functions as a polishing roller, because the circumferential surface of the cleaning roller makes pressurized contact with the circumferential surface of the photoconductor drum via the toner.

Preferably, the image forming apparatus comprises: an image forming apparatus body; image forming means disposed in the body and including the photoconductor drum and the cleaning device; document exposure/image reading means disposed within an upper end portion of the body and above the image forming means; a paper stack space portion disposed in a region between the image forming means and the document exposure/image reading means in the body; and a paper transport passage extending in a vertical direction beside the photoconductor drum and adapted to guide fed paper to the paper stack space portion.

Preferably, the photoconductor drum comprises an a-Si-based photoconductor drum, and a peripheral speed of the cleaning roller is greater than a peripheral speed of the photoconductor drum.

Preferably, the toner comprises a magnetic toner.

DETAILED DESCRIPTION OF THE PREFERRED EMBODIMENTS

Embodiments of a cleaning device constructed according to the present invention, and embodiments of an electrostatic copier, as an image forming apparatus, equipped with the cleaning device, and more specifically, an electrostatic copier of the in-body paper delivery type, will now be described in detail with reference to the accompanying drawings.

Figure 1:
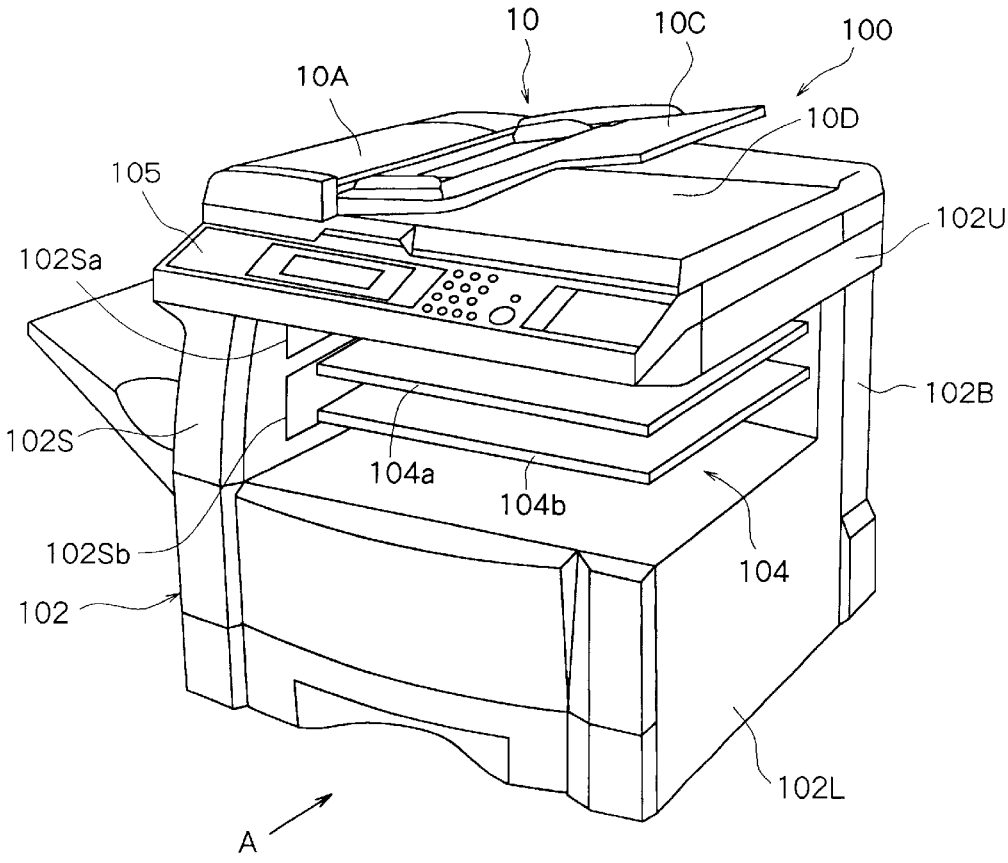
FIG. 1 is a perspective view showing an external outline configuration of an electrostatic copier of an in-body paper delivery type equipped with an embodiment of a cleaning device according to the present invention.
Figure 2:
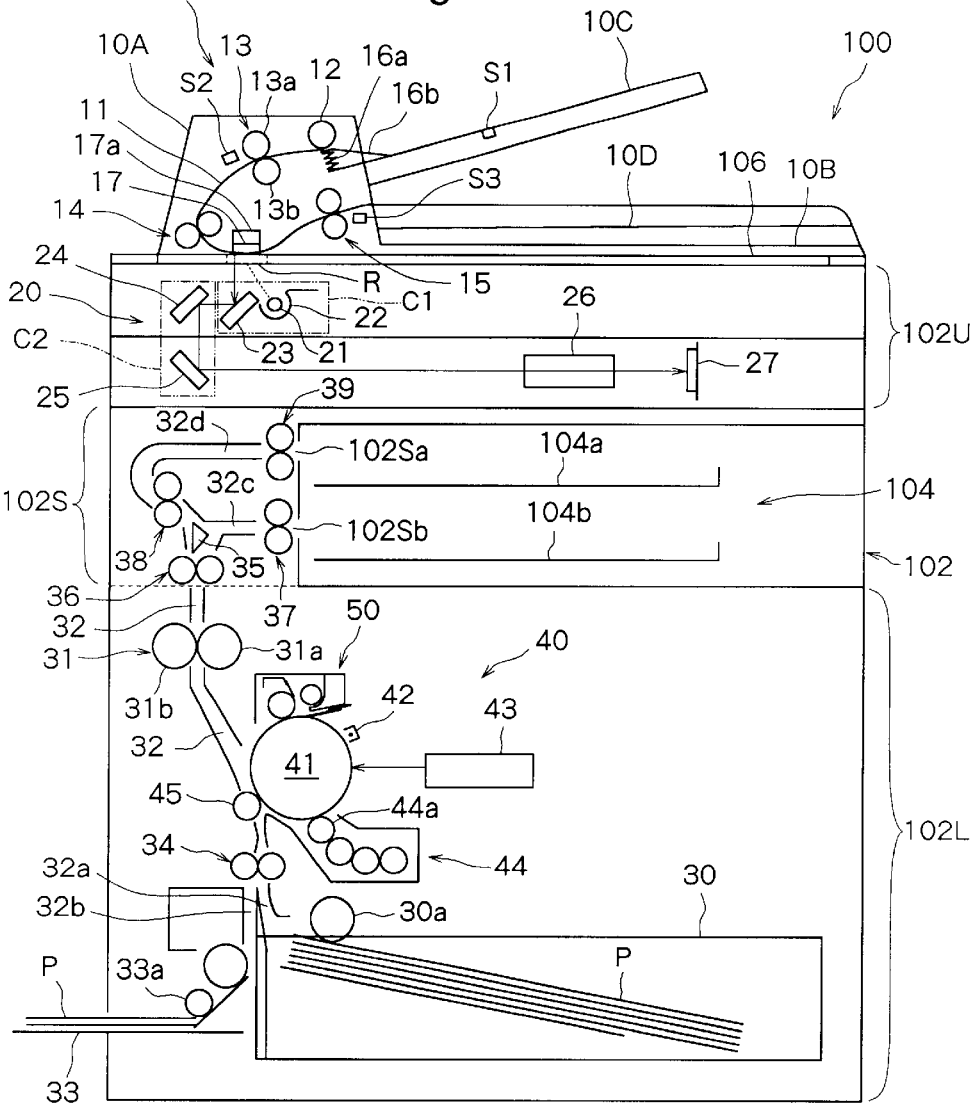
FIG. 2 is a front view of the copier shown in FIG. 1 as a sectional schematic view showing an internal construction.

With reference to FIGS. 1 and 2, a copier 100 has a copier body 102 having a nearly rectangular parallelopipedal contour as a whole. The copier body 102 has a lower body 102L, an upper body 102U disposed above the lower body 102L and at a distance therefrom, and a one-side portion connecting body 102S and a rear end portion connecting body 102B which connect the lower body 102L and the upper body 102U integrally to each other. When the copier body 102 is viewed from front (viewed in the direction of an arrow A in FIG. 1; viewed from the sheet face of FIG. 2), the one-side portion connecting body 102S extends vertically between one-side portions of the lower body 102L and the upper body 102U (between their left side portions in FIGS. 1 and 2) to connect these one-side portions, while the rear end portion connecting body 102B extends vertically between rear end portions of the lower body 102L and the upper body 102U to connect these rear end portions. The upper body 102U is present in an upper end portion of the copier body 102. In a space between the lower body 102L and the upper body 102U in the copier body 102, a paper stack space portion 104 is formed which is open at the front surface and the other side surface of the copier body 102 when the copier body 102 is viewed from front. The bottom surface of the paper stack space portion 104 comprises a horizontal upper surface of the lower body 102L, while the top surface of the paper stack space portion 104 comprises a horizontal lower surface of the upper body 102U. In the paper stack space portion 104, an upper paper receiving tray 104*a* and a lower paper receiving tray 104*b* are horizontally disposed with spacing in an up-down direction. In the one-side portion connecting body 102S, an upper paper outlet opening 102S*a* and a lower paper outlet opening 102S*b* are disposed with spacing in the up-down direction. Paper transported through a paper transport passage 32 (to be described later on) is let out onto the upper paper receiving tray 104*a* or the lower paper receiving tray 104*b* through the upper paper outlet opening 102S*a* or the lower paper outlet opening 102S*b*, respectively.

Figure 3:
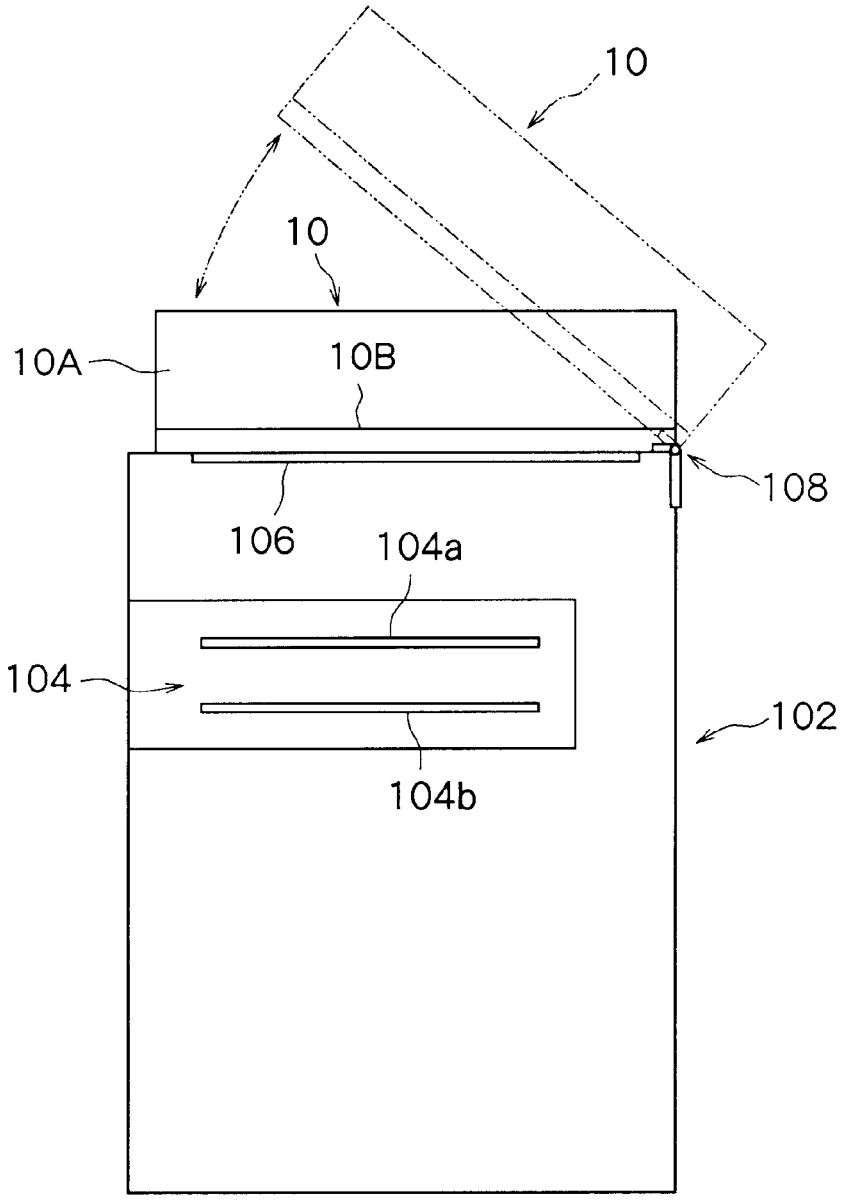
FIG. 3 is a schematic view of the copier shown in FIG. 1, as viewed from the right in FIG. 1, illustrating the open and closed states of a document feeder.

An operating panel 105 is disposed in a front region, opposed to an operator, of the upper surface of the upper body 102U, and a document bearing board 106 comprising a transparent glass plate is horizontally disposed in the other wide region of the upper surface of the upper body 102U. A document feeder 10 for transporting a document to an image reading position R so that the image of the document may be read is pivotally disposed on the upper body 102U. The document feeder 10 includes a document feeder body 10A, a document cover 10B, a document feeding tray 10C, and a document receiving tray 10D. The document cover 10B is formed integrally with the document feeder body 10A, and extends rightwardly horizontally in FIG. 2 from a lower end portion of the document feeder body 10A. The lower surface of the document cover 10B and the lower surface of the document feeder body 10A are existent on the same plane. The document receiving tray 10D is formed integrally with the upper surface of the document cover 10B. The document feeding tray 10C is disposed in the document feeder body 10A so as to extend obliquely upwardly to the right in FIG. 2 from an upper end portion of the document feeder body 10A. As shown in FIG. 3, the document feeder 10 is supported on the upper body 102U so as to be pivotable via hinge means 108 disposed on a rear side of the upper body 102U. The document feeder 10 is pivotable between a closed position indicated by solid lines in FIG. 3 and an open position indicated by two-dot chain lines in FIG. 3. When located at the closed position, the document feeder 10 covers the entire surface of the document bearing board 106 from above. When located at the open position, the document feeder 10 makes the entire surface of the document bearing board 106 open upwardly.

The document feeder 10, when located at the closed position, will be described further. A document transport passage 11 is disposed inside the document feeder body 10A. The document transport passage 11 extends obliquely downwardly to the left from a right-hand upper end portion of the document feeder body 10A in FIG. 2, curves and reverses toward the image reading position R disposed in a left end portion of the document bearing board 106, and then extends obliquely upwardly to the right toward a right-hand lower end portion of the document feeder body 10A in FIG. 2. The document feeding tray 10C is disposed on an extension of the upstream end of the document transport passage 11, and the document receiving tray 10D extends on an extension of the downstream end of the document transport passage 11. In the document feeder body 10A, a pickup roller 12, a transport roller pair 13, a register roller pair 14, and an outlet roller pair 15 are provided in this order along the document transport passage 11 from an upstream region toward a downstream region in the direction of document transport. The transport roller pair 13 is composed of a drive roller 13*a* and a separation roller 13*b*. The separation roller 13*b* rotationally moves in a direction opposite to the drive roller 13*a* at the site of nip only when the rotation load falls short of a predetermined torque. When the rotation load exceeds the predetermined torque, the separation roller 13*b* rotates following the drive roller 13*a*. A spring member 16*a* and a set document pressing member 16*b* are disposed in an upstream end region of the document transport passage 11 and nearly below the pickup roller 12. The set document pressing member 16*b* is urged upward toward the pickup roller 12 by the spring member 16*a*.

The image reading position R is provided between the register roller pair 14 and the outlet roller pair 15 in the document transport passage 11. At the image reading position R, the document transport passage 11 is formed by cooperation between the document feeder body 10A and the document bearing board 106. A white reference plate 17 for shading correction, and document hold-down means 17*a* are disposed in the document feeder body 10A. The white reference plate 17 is opposed to the document bearing board 106 from above at the image reading position R. The document hold-down means 17*a* is disposed on the upper side of the white reference plate 17 to press the white reference plate 17 against the upper surface of the document bearing board 106.

A plurality of sensors are disposed in the document feeder 10. That is, a document setting detection sensor S1 is disposed in a middle portion of the document feeding tray 10C, a feeding sensor S2 is disposed downstream from the transport roller pair 13, and a document outletting sensor S3 is disposed downstream from the outlet roller pair 15.

In the upper body 102U, document exposure/image reading means 20 is disposed for exposing the document, which is transported through the document transport passage 11 by the document feeder 10, to light at the image reading position R to read the image of the document. As shown in FIG. 2, the document exposure/image reading means 20 includes an exposure lamp 21, a reflecting plate 22 for reflecting light from the exposure lamp 21, a first mirror 23, a second mirror 24 and a third mirror 25 for receiving reflected light from the document passing the image reading position R and reflecting this light, a condenser lens 26, and an image sensor, e.g. a line type CCD, 27. The exposure lamp 21, the reflecting plate 22, and the first mirror 23 are loaded on a first carriage Cl which is movable in a right-left direction in FIG. 2. The second mirror 24 and the third mirror 25 are loaded on a second carriage C2 which is movable in the right-left direction in FIG. 2.

The copier 100 adopts two methods for reading the image of the document, a so-called sheet through method and a document fixing method. According to the sheet through method, with the document feeder 10 being located at the closed position, the image of the document passing the image reading position R is relatively scanned and read by the document exposure/image reading means 20 while the first carriage C1 and the second carriage C2 are being kept at a predetermined image reading stationary position (the position shown in FIG. 2). When the first carriage C1 and the second carriage C2 are at a standstill at the image reading stationary position shown in FIG. 2, the exposure lamp 21, the reflecting plate 22 and the first mirror 23 loaded on the first carriage C1 are positioned in a region nearly directly below the image reading position R. According to the document fixing method, on the other hand, with the document being placed on the upper surface of the document bearing board 106 and the document feeder 10 being located at the closed position, the first carriage C1 and the second carriage C2 are each moved, whereby the image of the document stopped on the upper surface of the document bearing board 106 is scanned and read by the document exposure/image reading means 20. Both types of reading the image of the document are available for the copier 100.

Operations of the document feeder 10 and the document exposure/image reading means 20 will be described in accordance with the above-mentioned sheet through method. With reference to FIG. 2, with the document feeder 10 being located at the closed position, n documents set on the document feeding tray 10C, with their image surfaces facing upward, are pressed against the pickup roller 12 at a predetermined pressure by the set document pressing member 16*b* urged upward by the spring member 16*a*. When a copy start button (not shown) disposed on the operating panel 105 is depressed into the ON-state, the pickup roller 12 and the transport roller pair 13 are rotationally driven by primary feeding drive means (not shown). The documents set on the document feeding tray 10C are sent, usually in plural numbers, starting with the upwardly facing side of the documents, to the transport roller pair 13 by the pickup roller 12. Of the plural documents sent to the transport roller pair 13, only the uppermost one document is separated by the separation roller 13*b*, and transported toward the register roller pair 14. After the front end of this document is detected by the feeding sensor S2 and then transported over a predetermined distance, the operation of the primary feeding drive means is stopped to halt the rotational driving of the transport roller pair 13 and the pickup roller 12, thus completing primary feeding. The document is stopped, with its front end being compressed by the nip of the register roller pair 14, and with a warp being formed at the front end.

A predetermined time after completion of primary feeding, secondary feeding is started. That is, the transport roller pair 13, the register roller pair 14, and the outlet roller pair 15 are rotationally driven by the operation of secondary feeding drive means (not shown). The document is transported toward the image reading position R and the outlet roller pair 15 by the register roller pair 14, and then finally let out onto the document receiving tray 10D by the outlet roller pair 15. When the document outletting sensor S3 provided downstream from the outlet roller pair 15 detects the passage of the rear end of the document, it can be determined that the image reading of one document has been completed. The document outletting sensor S3 has the counting function of counting the number of the documents whenever it detects the passage of the rear end of the document. If the document setting detection sensor S1 senses following documents, the transport of the second and subsequent documents is continued. The document, when passing the image reading position R, is transported while being pressed lightly against the surface of the document bearing board 106 by the white reference plate 17 and the document hold-down means 17*a*. During this transport, the image surface of the document is relatively exposed and scanned by the exposure lamp 21 of the document exposure/image reading means 20 which is opposed to the document, with the document bearing board 106 being sandwiched therebetween.

More concretely, the first carriage C1 and the second carriage C2 are held at the aforementioned image reading stationary position when the image of the document is to be read by the document exposure/image reading means 20. Light emitted from the exposure lamp 21 relatively scans the document passing the image reading position R. Reflected light from the document reaches the CCD 27 via the first mirror 23, the second mirror 24, the third mirror 25, and the condenser lens 26. As a result, the image of the document passing the image reading position R on the upper surface of the document bearing board 106 is relatively read and scanned by the document exposure/image reading means 20, focused in a scaled-down size onto the CCD 27, and converted into electrical signals thereby.

With further reference to FIG. 2, a paper feeding cassette 30 accommodating pieces of paper, image forming means 40 for forming an image on the paper, a fixing device 31, and a paper transport passage 32 are disposed in the lower body 102L of the copier body 102. The paper feeding cassette 30 is housed in a lower end portion of the lower body 102L so as to be withdrawable toward an operator in front of the copier 100. A manual paper feeding tray 33 is disposed in a left-hand lower end portion of the lower body 102L in FIG. 2 so as to be openable and closable.

The image forming means 40 disposed above the paper feeding cassette 30 includes a photoconductor drum 41, and disposed around the photoconductor drum 41, a main charger 42, a laser scanning unit 43, a developing device 44, a transfer roller 45 as transfer means, and a cleaning device 50 according to the present invention. The paper transport passage 32 extends vertically beside (in FIG. 2, on the left side of) the photoconductor drum 41. Because of this layout, a transfer zone is disposed nearly laterally of the circumferential surface of the photoconductor drum 41 (in FIG. 2, at a position nearly to the left of the circumferential surface and slightly below the center in the up-down direction of the circumferential surface), and the transfer roller 45 is in pressurized contact with the circumferential surface in the transfer zone. The cleaning device 50 is disposed above the photoconductor drum 41, and has a lower end portion open downward toward the circumferential surface of the photoconductor drum 41. The cleaning device 50 will be described in detail later on.

Two paper transport passages 32*a* and 32*b* merge with the upstream end of the paper transport passage 32. The upstream end of the paper transport passage 32*a* is connected to the paper feeding cassette 30, while the upstream end of the paper transport passage 32*b* is connected to the manual paper feeding tray 33. In the lower body 102L, there are also disposed a feed roller 30*a* for feeding pieces of paper P, accommodated in the paper feeding cassette 30, one by one to the paper transport passage 32 via the paper transport passage 32*a*, and a feed roller 33*a* for feeding pieces of paper P, set in the manual paper feeding tray 33, one by one to the paper transport passage 32 via the paper transport passage 32*b*. In the lower body 102L, a register roller pair 34 is disposed in the paper transport passage 32 upstream from the photoconductor drum 41 and at the position of merger between the paper transport passages 32*a* and 32*b*. On the paper transport passage 32, the fixing device 31 is disposed downstream from the photoconductor drum 41. The fixing device 31 includes a heat roller 31*a* and a pressure roller 31*b*.

The paper transport passage 32 further extends vertically upwardly into the one-side portion connecting body 102S, and branches into two paper transport passages 32*c* and 32*d* within the one-side portion connecting body 102S. A branching pawl 35 is disposed at the position of branching of the paper transport passages 32*c* and 32*d*. The paper transport passage 32*c* extends horizontally transversely (rightwardly in FIG. 2) from the position of branching, and is connected to the lower paper outlet opening 102S*b*. The paper transport passage 32*d* extends obliquely upwardly in FIG. 2 from the position of branching, then extends horizontally transversely (rightwardly in FIG. 2), and is connected to the upper paper outlet opening 102S*a*. Within the one-side portion connecting body 102S, a transport roller pair 36 is disposed directly upstream from the position of branching in the paper transport passage 32. An outlet roller pair 37 is disposed at the downstream end of the paper transport passage 32*c* and at a position directly upstream from the lower paper outlet opening 102S*b*. In the paper transport passage 32*d*, a transport roller pair 38 is disposed directly downstream from the position of branching, and an outlet roller pair 39 is disposed at the downstream end of the paper transport passage 32*d* and at a position directly upstream from the upper paper outlet opening 102S*a*. The branching pawl 35 is selectively switched by an actuator (not shown) between a first position indicated by solid lines in FIG. 2 and a second position (not shown).

In the image forming means 40, the photoconductor drum 41 comprises a positively chargeable a-Si-based photoconductor drum, and is rotationally driven by drive means (not shown) clockwise in FIG. 2 at a speed of 200 mm/sec. The circumferential surface of the photoconductor drum 41 is uniformly charged to +250 V by a corona discharge generated from the main charger 42 having a high voltage of 5 KV applied thereto. On the uniformly charged circumferential surface of the photoconductor drum 41, an electrostatic latent image comprising portions of a light potential of +10 V and a dark potential of +250 V is formed by laser light thrown from the laser scanning unit 43 in correspondence with the document image read by the CCD 27. In accordance with the rotation of the photoconductor drum 41, the electrostatic latent image is moved to a development zone formed by the photoconductor drum 41 in cooperation with a development sleeve to be described later on. The developing device 44 has a developing roller 44*a*, and the developing roller 44*a* has a development sleeve of stainless steel and a stationary magnet disposed within the development sleeve. In the development zone, the circumferential surface of the development sleeve is opposed to the circumferential surface of the photoconductor drum 41 with a clearance of 300 $\mu$m. The development sleeve is rotationally driven by drive means (not shown) so as to be rotationally moved in the development zone at a speed of 360 mm/second in the same direction as the photoconductor drum 41. The interior of the developing device 44 is filled with a positively charged magnetic toner having a volume averaged particle size of 9 $\mu$m (a median size by a coulter counter). A thin layer of the toner is formed on the circumferential surface of the development sleeve by a magnetic blade (not shown). A developing bias voltage, which comprises a direct current voltage of +100 V and an alternating current electric field with a frequency of 2 KHZ and a peak-to-peak voltage of 2 KV superimposed thereon, is applied to the developing roller 44*a*. The toner transported to the development zone is flied from the circumferential surface of the development sleeve by this developing bias to develop the electrostatic latent image formed on the circumferential surface of the photoconductor drum 41.

The pieces of paper P, which have been fed one by one from the paper feeding cassette 30 or the manual paper feeding tray 33 toward the paper transport passage 32, are moved in synchronism with the approach of the toner image formed on the circumferential surface of the photoconductor drum 41 to the transfer zone formed by the photoconductor drum 41 in cooperation with the transfer roller 45. That is, the timing of transporting the paper is adjusted by the register roller pair 34 in synchronism with the approach, and the paper is transported through the transfer zone between the photoconductor drum 41 and the transfer roller 45 along the paper transport passage 32. The paper P is passed through the transfer zone, with the front end of the paper P in alignment with the front end of the toner image formed on the circumferential surface of the photoconductor drum 41, whereby most of the toner in the toner image is transferred onto the paper P. The untransferred toner, remaining on the circumferential surface of the photoconductor drum 41 without transferring onto the paper P, is removed, as will be described later, by the cleaning device 50 in accordance with the rotation of the photoconductor drum 41. The paper P having the toner image transferred thereto is transported toward the fixing device 31 vertically upwardly along the paper transport passage 32 extending vertically beside the photoconductor drum 41. During the passage of the paper P between the heat roller 31*a* and the pressure roller 31*b* of the fixing device 31, the toner image transferred onto the paper P is fixed.

The paper P having the toner image fixed is further transported vertically upwardly along the paper transport passage 32. If the branching pawl 35 is switched to the first position indicated by the solid lines in FIG. 2, the paper P is introduced into the paper transport passage 32*c* by the transport roller pair 36, and let out by the outlet roller pair 37 onto the lower paper receiving tray 104*b* of the paper stack space portion 104 through the lower paper outlet opening 102S*b*. If the branching pawl 35 is switched to the second position (not shown), on the other hand, the paper P is introduced into the paper transport passage 32*d* by the transport roller pairs 36 and 38, and let out by the outlet roller pair 39 onto the upper paper receiving tray 104*a* of the paper stack space portion 104 through the upper paper outlet opening 102S*a*.

Figure 4:
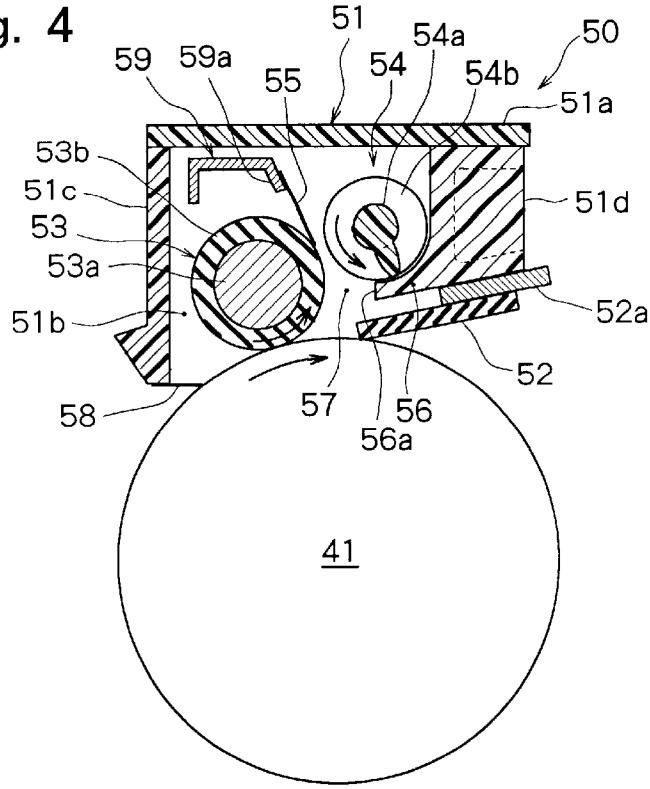
FIG. 4 is a sectional schematic view showing an internal construction of the cleaning device provided in the copier shown in FIG. 1.

Next, an embodiment of the cleaning device 50 constructed in accordance with the present invention will be described in detail with reference to FIG. 4. The cleaning device 50 has a housing 51 disposed above the photoconductor drum 41 and having an opening portion open downward toward the circumferential surface of the photoconductor drum 41. In more concrete terms, the housing 51 includes a top wall 51*a* extending with a predetermined width in the axial direction of the photoconductor drum 41 (in a direction perpendicular to the sheet face of FIG. 4), a pair of side walls 51*b* (only one of the side walls 51*b* is shown in FIG. 4) extending downwardly from opposite side edges in the fore-aft direction of the top wall 51*a* (in the direction perpendicular to the sheet face of FIG. 4), an upstream end wall 51*c* extending in the fore-aft direction between one end of the side wall 51*b* and one end of the other side wall 51*b* located upstream in the direction of rotation of the photoconductor drum 41 (these ends are left ends in FIG. 4), and a downstream end wall 51*d* extending in the fore-aft direction between the other end of the side wall 51*b* and the other end of the other side wall 51*b* located downstream in the direction of rotation of the photoconductor drum 41 (these ends are right ends in FIG. 4). The opening portion of the housing 51 is formed by the lower ends of the respective side walls 51*b*, the upstream end wall 51*c* and the downstream end wall 51*d* of the housing 51, the lower ends being opposed to the circumferential surface of the photoconductor drum 41.

Within the housing 51, there are provided a cleaning blade 52 for removing the toner remaining on the circumferential surface of the photoconductor drum 41, and a cleaning roller 53 for cleaning the circumferential surface of the photoconductor drum 41 by sliding over, rubbing against and polishing it. The cleaning blade 52 is disposed in the housing 51 so as to be located in the opening portion of the housing 51 at a position downstream in the direction of rotation of the photoconductor drum 41 (i.e. clockwise in FIG. 4). The cleaning roller 53 is disposed in the housing 51 so as to be located in the opening portion of the housing 51 at a position upstream from the cleaning blade 52 in the direction of rotation of the photoconductor drum 41. Within the housing 51, there are also disposed a spiral roller 54, as toner outletting spiral means, for letting the toner recovered into the housing 51 (in other words, cleaning toner) out of the housing 51, accordingly, out of the cleaning device 50, and a scraper 55 for scraping off the toner adhering to the surface of the cleaning roller 53. The spiral roller 54 is disposed above and spaced from the cleaning blade 52. Within the housing 51, a partition wall 56 is disposed between the cleaning blade 52 and the spiral roller 54, and a toner movement space 57 for moving the toner recovered into the housing 51 is formed between the front end 56*a* of the partition wall 56 and the circumferential surface of the cleaning roller 53. A seal blade 58 for preventing leakage of the toner recovered into the housing 51 to the outside is disposed on the lower end surface of the upstream end wall 51*c* of the housing 51.

The cleaning blade 52 of a strip shape having a constant width and a constant thickness has a base end region in its width direction integrally fastened to the lower surface of a batten-shaped metallic mounting member 52*a* by a suitable fastening means, for example, adhesion. The mounting member 52*a* is secured to the lower end surface of the downstream end wall 51*d* of the housing 51 by a suitable fastening means, for example, a screw. Thus, the cleaning blade 52 is mounted to the housing 51 via the mounting member 52*a*, and extends in the axial direction of the photoconductor drum 41. The lower end surface of the downstream end wall 51*d* of the housing 51 is inclined downwardly toward the upstream end wall 51*c*, accordingly, in a direction approaching the circumferential surface of the photoconductor drum 41. Thus, the cleaning blade 52 is also inclined downward toward the circumferential surface of the photoconductor drum 41. The cleaning blade 52, which comprises synthetic rubber having suitable hardness, polyurethane rubber with JIS hardness of 78° in the embodiment, has a thickness set at 2.0 mm and a length of extension from the front end of the mounting member 52*a* (i.e., the length from the front end of the mounting member 52*a* to the free end of the cleaning blade 52) set at 10.0 mm. The front end portion of the cleaning blade 52 has its front end directed in a direction opposite to the direction of rotation of the photoconductor drum 41, and brought into pressurized contact with the circumferential surface of the photoconductor drum 41. The amount of relative bite of the cleaning blade 52 into the photoconductor (i.e., the amount of elastic deformation of the photoconductor) at the site of pressurized contact with the circumferential surface of the photoconductor drum 41 is set at 1.5 mm. The cleaning blade 52 is mounted at an angle of 22° in the embodiment so as to make an acute angle with the tangent to the site of pressurized contact of the cleaning blade 52 with the circumferential surface of the photoconductor drum 41, when the photoconductor drum 41 is viewed in the axial direction (in the direction perpendicular to the sheet face of FIG. 4). The site of pressurized contact of the cleaning blade 52 with the circumferential surface of the photoconductor drum 41, when the photoconductor drum 41 is viewed in the axial direction, exists directly downstream from the summit of the circumferential surface of the photoconductor drum 41, in the embodiment shown in FIG. 4. The force of pressurized contact of the cleaning blade 52 with the circumferential surface of the photoconductor drum 41 is set at 5 g/mm.

The cleaning roller 53 comprises a metallic shaft, and synthetic rubber covering the periphery of the shaft to a predetermined thickness. In the embodiment, the cleaning roller 53 comprises a metallic shaft 53*a* having a circular section with a diameter of 10 mm, and a foam 53*b* of EPDM rubber (Asker C hardness 55°) covering the periphery of the shaft with a thickness of 2.5 mm. The synthetic rubber layer of the cleaning roller 53 is not limited to the above embodiment, but may be formed of other synthetic rubber or foamed synthetic rubber, and the preferred material has an Asker C hardness of 10° to 90°. The cleaning roller 53 is rotatably supported between the respective side walls 51*b* of the housing 51, and its circumferential surface is in pressurized contact with the circumferential surface of the photoconductor drum 41. The circumferential surface of the cleaning roller 53 is rotationally driven by drive means (not shown) so as to be rotationally moved in the same direction as the circumferential surface of the photoconductor drum 41 at the site of contact of the circumferential surface of the cleaning roller 53 with the circumferential surface of the photoconductor drum 41. That is, in FIG. 4, the photoconductor drum 41 is rotationally driven clockwise, while the cleaning roller 53 is rotationally driven counterclockwise. The peripheral speed of the cleaning roller 53 is set at 1.2 times the peripheral speed of the photoconductor drum 41. The site of pressurized contact of the cleaning roller 53 with the circumferential surface of the photoconductor drum 41, when the photoconductor drum 41 is viewed in the axial direction, exists directly upstream from the summit of the circumferential surface of the photoconductor drum 41, in the embodiment shown in FIG. 4. When the photoconductor drum 41 is viewed in the axial direction, a predetermined gap for recovering the toner recovered from the circumferential surface of the photoconductor drum 41 into the housing 51 is provided between the site of pressurized contact of the cleaning roller 53 with the circumferential surface of the photoconductor drum 41 and the site of pressurized contact of the cleaning blade 52 with the circumferential surface of the photoconductor drum 41. a A mounting stay 59 comprising a metal plate is disposed between the respective side walls 51*b* of the housing 51 and above the cleaning roller 53. The mounting stay 59 has a strip-shaped flat plate portion having a constant width, a flange portion extending downwardly from one side edge of the flat plate portion (the one side edge located upstream in the direction of rotation of the photoconductor drum 41), and an inclined flange portion 59*a* extending obliquely downwardly from the other side edge of the flat plate portion (the other side edge located downstream in the direction of rotation of the photoconductor drum 41) away from the flange portion. The strip-shaped scraper 55 having a constant width and a constant thickness has a base end region in its width direction fastened to the upper surface of the inclined flange portion 59*a* of the mounting stay 59 by a suitable fastening means, for example, adhesion. The scraper 55 comprising a metallic thin plate having suitable elasticity, an elastic thin plate of stainless steel (sus304) 0.05 mm thick in the embodiment, extends from the inclined flange portion 59*a* of the mounting stay 59. A front end portion of the scraper 55 has its front end directed in a direction opposite to the direction of rotation of the cleaning roller 53, and kept in pressurized contact with the circumferential surface of the cleaning roller 53, downstream from the site of pressurized contact between the circumferential surface of the cleaning roller 53 and the circumferential surface of the photoconductor drum 41 in the direction of rotation of the cleaning roller 53. In the embodiment, the scraper 55 is disposed so as to be capable of scraping off the toner adhering to the circumferential surface of the cleaning roller 53 into the gap between the cleaning roller 53 and the spiral roller 54. That is, the scraper 55 extends in the direction of a tangent to the circumferential surface of the cleaning roller 53, the tangent intersecting nearly perpendicularly to a straight line connecting the center of rotation of the cleaning roller 53 to the center of rotation of the spiral roller 54. The site of pressurized contact of the scraper 55 with the circumferential surface of the cleaning roller 53 is existent directly above a position on the circumferential surface of the cleaning roller 53, the position being closest to a rotation region of the spiral roller 54 (to be described later on), and is also existent directly downstream in the direction of rotation of the cleaning roller 53. That is, the scraper 55 extends in the direction of the tangent, with the front end of the scraper 55 being directed toward the position on the circumferential surface of the cleaning roller 53, the position most approaching the rotation region of the spiral roller 54.

The spiral roller 54 disposed above and apart from the cleaning blade 52 has a shaft 54*a* having a circular section, and a spiral blade 54*b* extending axially on the outer peripheral surface of the shaft 54*a*. In a partial region of the shaft 54*a*, a plate blade for agitation is also disposed which extends radially outwardly from the outer peripheral surface of the shaft 54*a*. The spiral roller 54, which can be formed of a suitable synthetic resin or metal, is rotatably supported between the side walls 51*b* of the housing 51, and is rotationally driven counterclockwise in FIG. 4 by drive means (not shown). The diameter of the spiral roller 54, i.e., the diameter of the spiral blade 54*b*, is the same as the diameter of the locus of rotation of the radially outward front end of the spiral blade 54*b*, and a cylindrical region surrounded by the loci of rotation defines the rotation region of the spiral roller 54. Thus, the diameter of the rotation region is the same as the diameter of the spiral blade 54*b*. The spiral roller 54 is disposed practically downstream from the cleaning roller 53 in the direction of rotation of the photoconductor drum 41, and the center of rotation of the spiral roller 54 is located above the center of rotation of the cleaning roller 53. The circumferential surface of the rotation region of the spiral roller 54 is oppose to the circumferential surface of the cleaning roller 53 with spacing provided practically downstream in the direction of rotation of the photoconductor drum 41. The axes of the cleaning roller 53 and the spiral roller 54 are parallel to the axis of the photoconductor drum 41.

The aforementioned partition wall 56 is formed in a space region, where the spiral roller 54 and the cleaning blade 52 are opposed in the up-down direction, so as to extend from an inner surface of the lower end portion of the downstream end wall 51*d* of the housing 51 toward the interior of the housing 51 and toward the upstream end wall 51*c* of the housing 51. In other words, when the rotation region of the spiral roller 54 is viewed in the vertical direction, the partition wall 56 extends out from the downstream end toward the upstream end of the rotation region in the direction of rotation of the photoconductor drum 41. The upper surface of the partition wall 56 is opposed, with a nearly constant slight gap, to the outer peripheral surface of the rotation region of the spiral blade 54*b* of the spiral roller 54, while the lower surface of the partition wall 56 is opposed, with a slight gap, to the upper surface of the cleaning blade 52. These gaps should preferably be minimal unless problematical for practical use. Most of the space region where the spiral roller 54 and the cleaning blade 52 are opposed in the up-down direction is accounted for by the partition wall 56. Between the front end 56*a* of the partition wall 56 and the circumferential surface of the cleaning roller 53, a toner movement space 57 is formed for moving the toner recovered into the housing 51. The toner movement space 57 continues into the aforementioned space formed above the region between the site of pressurized contact of the cleaning roller 53 and the site of pressurized contact of the cleaning blade 52 with the circumferential surface of the photoconductor drum 41. The partition wall 56 blocks most of the space between the spiral roller 54 and the cleaning blade 52, except at least the toner movement space 57.

The aforesaid seal blade 58 is in pressurized contact with the circumferential surface of the photoconductor drum 41 upstream from the site of pressurized contact of the cleaning roller 53 with the photoconductor drum 41 in the direction of rotation of the photoconductor drum 41. The seal blade 58 has the front end disposed practically in the direction of rotation of the photoconductor drum 41. Also, when the photoconductor drum 41 is viewed in the axial direction, the seal blade 58 is disposed so as to make an acute angle with the tangent to the site of pressurized contact of the seal blade 58 with the circumferential surface of the photoconductor drum 41. As shown in FIG. 4, the seal blade 58 in the embodiment is inclined slightly downwardly toward the circumferential surface of the photoconductor drum 41.

When the copying action of the copier 100 is performed in the aforementioned manner, the electrostatic latent image formed on the circumferential surface of the rotating photoconductor drum 41 is developed with the toner, and the developed toner image is transferred onto the paper P by the transfer roller 45. The untransferred toner remaining on the circumferential surface of the photoconductor drum 41 is rotationally moved toward the cleaning device 50 in accordance with the rotation of the photoconductor drum 41. The cleaning roller 53 of the cleaning device 50 functions as a polishing roller when the circumferential surface of the cleaning roller 53 makes pressurized contact with the circumferential surface of the photoconductor drum 41 via the toner and slides over and rubs the circumferential surface of the photoconductor drum 41. Thus, the cleaning roller 53 can maintain the circumferential surface of the photoconductor drum 41 always in a clean state. That is, the cleaning roller 53 strips off part of the toner remaining on the circumferential surface of the photoconductor drum 41, or mechanically disturbs the toner, if does not remove it, thereby bringing the toner into a state easily detachable from the circumferential surface, namely, an easily cleanable state. Moreover, the cleaning roller 53 prevents a fusion of the toner from occurring and growing, with the additives released from the toner serving as a core. Furthermore, the cleaning roller 53 removes a filming layer of the toner formed on the circumferential surface of the photoconductor drum 41. If the photoconductor drum 41 comprises an a-Si-based photoconductor drum, the cleaning roller 53 can maintain the circumferential surface of the photoconductor drum 41 always clean by, for example, removing a deteriorated surface layer due to ozone from the circumferential surface of the photoconductor drum 41. The toner deposited on the surface of the cleaning roller 53 can be scraped off by the scraper 55. Thus, the cleaning roller 53 can be constantly restored to a clean circumferential surface, and so can retain the desired cleaning performance for a long period of time.

In the foregoing copier 100, the photoconductor drum 41 comprises an a-Si-based photoconductor drum, and the peripheral speed of the cleaning roller 53 is greater than the peripheral speed of the photoconductor drum 41. According to these features, even when the a-Si-based photoconductor drum apt to cause image distortion is used, the circumferential surface of the photoconductor drum 41 can be polished by sliding and rubbing by the circumferential surface of the cleaning roller 53 and the recovered toner adhering to the circumferential surface of the cleaning roller 53. Thus, image distortion, filming of the toner, and toner deposition, which occur on the circumferential surface of the photoconductor drum 41, can be prevented, and the maintenance cycle can be prolonged. Furthermore, the peripheral speed of the cleaning roller 53 is made higher than the peripheral speed of the photoconductor drum 41, whereby the above polishing action can be performed more effectively. In the above embodiment of the present invention, the peripheral speed of the cleaning roller 53 is set at 1.2 times the peripheral speed of the photoconductor drum 41, but this is not restrictive, and is preferably set at 1.05 to 2.5 times the latter peripheral speed. If the peripheral speed of the cleaning roller 53 is less than 1.05 times the peripheral speed of the photoconductor drum 41, there will be a decline in the cleaning effect of the cleaning roller 53 on the toner deposited on the circumferential surface of the photoconductor drum 41. Hence, black spot-like copy smudges, filming of toner, and image distortion on the a-Si-based photoconductor drum tend to occur easily. If the peripheral speed of the cleaning roller 53 is more than 2.5 times the peripheral speed of the photoconductor drum 41, there will be an impediment to the smooth rotation of the photoconductor drum 41, and jitter due to uneven rotations is liable to occur. These problems are solved by setting the peripheral speed of the cleaning roller 53 to be within the range of 1.05 to 2.5 times the peripheral speed of the photoconductor drum 41. The remaining toner, which has not been removed from the circumferential surface of the photoconductor drum 41 by the cleaning roller 53, is completely removed by the cleaning blade 52 disposed downstream from the cleaning roller 53.

Within the housing 51, the spiral roller 54 for outletting the toner recovered into the housing 51 is disposed above the cleaning blade 52, the partition wall 56 is disposed between the cleaning blade 52 and the spiral roller 54, and the toner movement space 57 for moving the toner recovered into the housing 51 is formed between the front end 56*a* of the partition wall 56 and the circumferential surface of the cleaning roller 53. According to this construction, the cleaning roller 53, the cleaning blade 52 and the spiral roller 54 can be accommodated in the housing 51 compactly. As a result, a compact cleaning device 50 and a compact copier 100 can be obtained. Particularly, it becomes possible to promptly flow the recovered toner to the spiral roller 54, which exists above the partition wall 56, through the toner movement space 57 between the front end 56*a* of the partition wall 56 and the cleaning roller 53. Thus, toner agglomeration and toner blocking can be prevented until the recovered toner is withdrawn to the outside. Also, the presence of the partition wall 56 prevents the sinking of the recovered toner under its own weight. The recovered toner can be promptly transported and let out of the cleaning device 50 by the spiral roller 54 without being leaked to the outside.

The act of letting out the recovered toner will be described in further detail. The toner recovered into the housing 51 by the cleaning roller 53 and the cleaning blade 52 is rendered stagnant in a lower part of the toner movement space 57, and gradually increased. Most of the space between the cleaning blade 52 and the spiral roller 54, which is the space above the cleaning blade 52 and the space below the spiral roller 54, is closed by the partition wall 56, except at least the toner movement space 57. Thus, the toner recovered into the housing 51 is smoothly and promptly raised toward the rotation region of the spiral roller 54 through the toner movement space 57 with the assistance of the rotating and transporting action of the circumferential surface of the cleaning roller 53, without stagnating on the cleaning blade 52, and is advanced into the rotation region of the spiral roller 54. The recovered toner advanced into the rotation region of the spiral roller 54 is prevented from sinking downward under its own weight, because the lower side of the rotation region is supported by the partition wall 56. Thus, the recovered toner is promptly transported and let out by the spiral roller 54, without leaking to the outside, into a toner recovery container (not shown) disposed outside the cleaning device 50. Moreover, toner agglomeration and the formation of toner blocks can be prevented until the recovered toner is withdrawn to the outside.

The circumferential surface of the cleaning roller 53 is rotationally moved in the same direction as the circumferential surface of the photoconductor drum 41 at the site of pressurized contact between these circumferential surfaces. The scraper 55 is disposed within the housing 51, and the front end portion of the scraper 55 is kept in pressurized contact with the circumferential surface of the cleaning roller 53 downstream from the site of pressurized contact between the circumferential surfaces in the direction of rotation of the cleaning roller 53, with the front end of the scraper 55 being directed in a direction opposite to the direction of rotation of the cleaning roller 53. According to these features, the recovered toner adhering to the circumferential surface of the cleaning roller 53 is effectively separated by the front end portion of the scraper 55 contacted under pressure with the circumferential surface of the cleaning roller 53 so as to be opposed to the direction of rotation of the circumferential surface of the cleaning roller 53. The recovered toner adhering to the circumferential surface of the cleaning roller 53 includes not only the recovered toner, which has been moved onto the circumferential surface of the cleaning roller 53 as a result of the polishing of the circumferential surface of the photoconductor drum 41 slid over and rubbed against by the circumferential surface of the cleaning roller 53, but also part of the recovered toner which has been removed from the circumferential surface of the photoconductor drum 41 by the cleaning blade 52, brought into contact with the circumferential surface of the cleaning roller 53, and thereby deposited on the circumferential surface of the cleaning roller 53.

In the above-described embodiment of the present invention, the scraper 55 is disposed so as to be capable of scraping off the toner adhering to the circumferential surface of the cleaning roller 53 to the space between the cleaning roller 53 and the spiral roller 54. According to this feature, the recovered toner that has been scraped off the circumferential surface of the cleaning roller 53 by the scraper 55 can be directed to a position where the spiral roller 54 can easily receive the recovered toner. Thus, the recovered toner can be promptly fed into the rotation region of the spiral roller 54. As a result, the recovered toner can be transported and let out with high efficiency to the outside of the cleaning device 50. The toner scraped off to the space between the cleaning roller 53 and the spiral roller 54 is inhibited from falling toward the photoconductor drum 41, by the recovered toner rising from below. As a result, the scraped toner is moved toward the spiral roller 54 together with the recovered toner rising from below, and transported and taken out of the cleaning device 50 highly efficiently by the spiral roller 54. There is another embodiment in which the scraper 55 is disposed so as to be capable of scraping off the toner, which has adhered to the circumferential surface of the cleaning roller 53, toward the rotation region of the spiral roller 54. In this embodiment, the scraper 55 is disposed such that its front end is opposed to the rotation region of the spiral roller 54. Thus, the above actions and effects can be achieved even more efficiently. In the aforementioned embodiment, the direction of mounting of the scraper 55 is tangent to the site of pressurized contact of the scraper 55 with the circumferential surface of the cleaning roller 53, but this is not restrictive, and the scraper 55 may have a predetermined angle to the tangent to the site of pressurized contact. The thickness of the scraper 55 is preferably within the range of 0.02 to 2.0 mm. In the aforementioned embodiment, the scraper 55 is formed of SUS304 having weak magnetism, but this is not restrictive, and the scraper 55 may be formed of a nonmagnetic SUS plate, a blade plate of any of various resins or metals, or a rubber blade plate.

Figure 5:
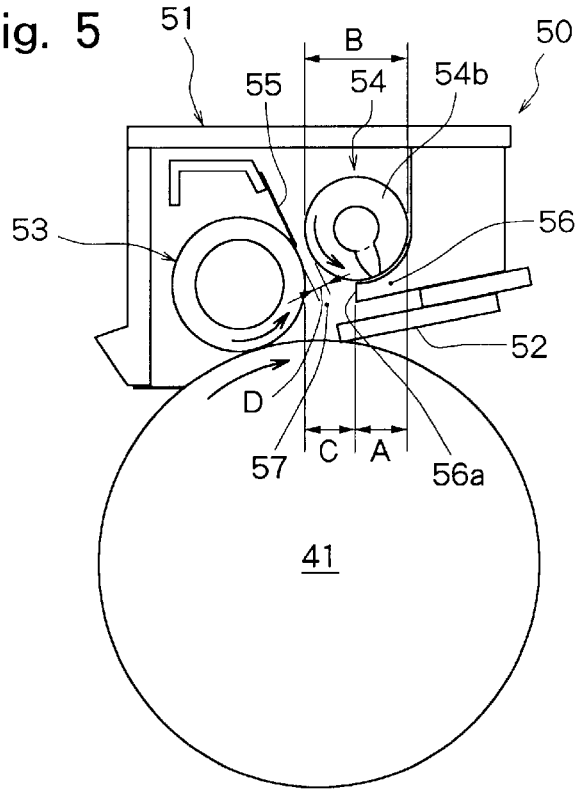
FIG. 5 is a sectional schematic view for illustrating the positional relationship among constituent elements in the cleaning device shown in FIG. 4.

When the rotation region of the spiral roller 54 is viewed in the vertical direction, the partition wall 56 extends out from the downstream end toward the upstream end of the rotation region in the direction of rotation of the photoconductor drum 41. When the rotation region is viewed in the vertical direction, the effective length of shielding, A, of the rotation region by the partition wall 56 is preferably 30% or more of the diameter of the rotation region. As will be easily understood by reference to FIG. 5, this effective shielding length A means what percentage of the diameter of the rotation region, B, the partition wall 56 shields in the direction from the base end of the diameter B toward the upstream end of the diameter B by extending out from the base end toward the upstream end, when the rotation region is viewed in the vertical direction, the base end defining one end of the diameter B of the rotation region and being the downstream end (the right end in FIG. 5) in the direction of rotation of the photoconductor drum 41, and the upstream end (the left end in FIG. 5) defining the other end of the diameter B of the rotation region. If the diameter B is shielded over the range from the base end up to the upstream end, the effective shielding length A is 100%. If the effective shielding length A is 30% or more, the sinking of the recovered toner, which has risen from the toner movement space 57, can be effectively prevented, and toner agglomeration and formation of toner blocks can be prevented until the recovered toner is withdrawn to the outside. During this process, the prompt transport and withdrawal, by the spiral roller 54, of the recovered toner to the outside of the cleaning device 50 can be effectively performed for practical use, without leakage of the recovered toner to the outside. If the effective shielding length A is less than 30%, the sinking of the toner to the lower part of the toner movement space 57 is slightly increased, making the toner tend to stagnate. In the aforementioned embodiment of the present invention, the front end 56*a* of the partition wall 56 is disposed nearly vertically below the center of rotation of the spiral roller 54. This arrangement means that the effective shielding length A is about 50%. If the effective shielding length A is set at nearly 50%, the sinking of the recovered toner, which has moved toward the spiral roller 54, can be prevented particularly effectively, and toner agglomeration and formation of toner blocks can be prevented until the recovered toner is withdrawn to the outside. During this process, the prompt transport and withdrawal, by the spiral roller 54, of the recovered toner to the outside of the cleaning device 50 can be effectively performed for practical use, without leakage of the recovered toner to the outside.

The horizontal distance C (see FIG. 5) at which the front end 56*a* of the partition wall 56 and the circumferential surface of the cleaning roller 53 maximally approach each other should preferably be 2 mm or more. According to this feature, the recovered toner satisfactorily rises toward the upper part of the toner movement space 57 without stagnating. As a result, the prompt transport and withdrawal, by the spiral roller 54, of the recovered toner to the outside of the cleaning device 50 can be effectively performed for practical use. If the horizontal distance C for maximal approach is less than 2 mm, the rising of the recovered toner toward the upper part of the toner movement space 57 is slightly poor, and the recovered toner tends to be stagnant. In the above embodiment of the present invention, the horizontal distance C for maximal approach is 7 mm, which makes it possible to achieve the aforementioned actions effectively for practical use.

The distance D at which the circumferential surface of the cleaning roller 53 and the rotation region of the spiral roller 54 maximally approach each other (see FIG. 5) is preferably 3 mm or less. According to this feature, there is an increase in the ratio of the recovered toner directly falling toward the spiral roller 54 to the recovered toner scraped off the circumferential surface of the cleaning roller 53 by the scraper 55. This makes it possible, for practical use, to move the recovered toner toward the spiral roller 54 highly efficiently, and transport and withdraw it to the outside of the cleaning device 50 with better efficiency. In the present embodiment, the distance D for maximal approach is set at 1.5 mm, enabling the above-mentioned actions to be achieved effectively for practical use.

According to the copier 100 equipped with the foregoing cleaning device 50, the aforementioned actions and effects by the cleaning device 50 are obtained, and the cleaning device 50 can be downsized. Thus, the photoconductor drum 41 and the copier 100 can be easily scaled down. Moreover, increased allowance is made for the installation space for imaging elements disposed around the photoconductor drum 41, such as the developing device 44, main charger 42 and transfer roller 45. Thus, the copier 100 can be designed easily.

The copier 100 comprises the copier body 102, the image forming means 40 disposed in the body 102 and including the photoconductor drum 41 and the cleaning device 50, the document exposure/image reading means 20 disposed within the upper end portion of the body 102 and above the image forming means 40, the paper stack space portion 104 disposed in the region between the image forming means 40 and the document exposure/image reading means 20 in the body 102, and the paper transport passage 32 extending vertically beside the photoconductor drum 41 and adapted to guide the fed paper P to the paper stack space portion 104. According to the so constructed in-body paper delivery type copier 100, the cleaning device 50 can be downsized. Thus, the photoconductor drum 41 can be made compact. As a result, the copier 100 can be easily scaled down. Moreover, increased allowance is made for the installation space for the imaging elements disposed around the photoconductor drum 41, such as the developing device 44, main charger 42 and transfer roller 45. Thus, the copier 100 can be designed easily.

The toner used in the copier 100 is preferably a magnetic toner. For the reasons stated earlier, the magnetic toner has the property of easily depositing on the circumferential surface of the photoconductor drum 41 as compared with a nonmagnetic toner. However, the provision of the cleaning device 50 can effectively eliminate the deposition of the toner on the circumferential surface of the photoconductor drum 41, thus preventing the occurrence of black spot-like copy smudges, corresponding to toner deposits, on the surface of the paper P which is a copy. Moreover, a high copying speed can be achieved, with satisfactory image formation being ensured.

The image forming apparatus equipped with the cleaning device 50 is composed of an in-body paper delivery type copier 100 according to the above-described embodiment. However, the present invention can be applied to a copier or laser printer in other embodiment, especially a copier or laser printer having a paper transport passage extending vertically beside a photoconductor drum. In the aforementioned embodiment, moreover, the most typical paper is exemplified as a material on which to record an image. The paper may be a sheet member capable of having an image recorded thereon, so that the paper refers to a sheet member capable of having an image recorded thereon.

What we claim is:

1. A cleaning device comprising:

a housing disposed above a photoconductor drum and having an opening portion open downward toward a circumferential surface of the photoconductor drum;

a cleaning blade disposed in the housing so as to be located in the opening portion downstream in a direction of rotation of the photoconductor drum; and a cleaning roller disposed in the housing so as to be located in the opening portion upstream from the cleaning blade in the direction of rotation of the photoconductor drum, and wherein, in the housing, toner outletting spiral means for letting out a toner recovered into the housing is disposed above the cleaning blade;

a partition wall is disposed between the cleaning blade and the toner outletting spiral means; and a toner movement space for moving the toner recovered into the housing is formed between a front end of the partition wall and a circumferential surface of the cleaning roller.

2. The cleaning device of claim 1, wherein when a rotation region of the toner outletting spiral means is viewed in a vertical direction, the partition wall extends out from a downstream end of the rotation region toward an upstream end of the rotation region in the direction of rotation of the photoconductor drum, and when the rotation region is viewed in the vertical direction, an effective length of shielding of the rotation region by the partition wall is 30% or more of a diameter of the rotation region.

3. The cleaning device of claim 2, wherein the front end of the partition wall is disposed nearly vertically below a center of rotation of the toner outletting spiral means.

4. The cleaning device of claim 1, wherein a horizontal distance at which the front end of the partition wall and the circumferential surface of the cleaning roller maximally approach each other is 2 mm or more.

5. The cleaning device of claim 1, wherein the circumferential surface of the cleaning roller rotationally moves in the same direction as the circumferential surface of the photoconductor drum at a site of pressurized contact between the circumferential surface of the cleaning roller and the circumferential surface of the photoconductor drum, a scraper is disposed within the housing, and a front end portion of the scraper is brought into pressurized contact with the circumferential surface of the cleaning roller at a position downstream from the site of pressurized contact between the circumferential surface of the cleaning roller and the circumferential surface of the photoconductor drum in a direction of rotation of the cleaning roller, with a front end of the scraper being directed in a direction opposite to the direction of rotation of the cleaning roller.

6. The cleaning device of claim 5, wherein the scraper is disposed so as to be capable of scraping off the toner deposited on the circumferential surface of the cleaning roller either to a gap between the cleaning roller and the toner outletting spiral means, or toward a rotation region of the toner outletting spiral means.

7. The cleaning device of claim 1, wherein a distance at which the circumferential surface of the cleaning roller and a rotation region of the toner outletting spiral means maximally approach each other is 3 mm or less.

8. The cleaning device of claim 1, wherein the cleaning roller functions as a polishing roller, because the circumferential surface of the cleaning roller makes pressurized contact with the circumferential surface of the photoconductor drum via the toner.

9. A cleaning device comprising:

a housing disposed above a photoconductor drum and having an opening portion open downward toward a circumferential surface of the photoconductor drum;

a cleaning blade disposed in the housing so as to be located in the opening portion downstream in a direction of rotation of the photoconductor drum; and a cleaning roller disposed in the housing so as to be located in the opening portion upstream from the cleaning blade in the direction of rotation of the photoconductor drum, and wherein toner outletting spiral means for letting out a toner recovered into the housing is disposed above the cleaning blade in the housing;

a scraper is disposed within the housing;

a circumferential surface of the cleaning roller rotationally moves in the same direction as the circumferential surface of the photoconductor drum at a site of pressurized contact between the circumferential surface of the cleaning roller and the circumferential surface of the photoconductor drum;

a front end portion of the scraper is brought into pressurized contact with the circumferential surface of the cleaning roller at a position downstream from the site of pressurized contact between the circumferential surface of the cleaning roller and the circumferential surface of the photoconductor drum in a direction of rotation of the cleaning roller, with a front end of the scraper being directed in a direction opposite to the direction of rotation of the cleaning roller; and the scraper is disposed so as to be capable of scraping off the toner deposited on the circumferential surface of the cleaning roller either to a gap between the cleaning roller and the toner outletting spiral means, or toward a rotation region of the toner outletting spiral means.

10. The cleaning device of claim 9, wherein, in the housing, a partition wall is disposed between the cleaning blade and the toner outletting spiral means; and a toner movement space for moving the toner recovered into the housing is formed between a front end of the partition wall and the circumferential surface of the cleaning roller.

11. The cleaning device of claim 9, wherein the cleaning roller functions as a polishing roller, because the circumferential surface of the cleaning roller makes pressurized contact with the circumferential surface of the photoconductor drum via the toner.

12. An image forming apparatus comprising:

a photoconductor drum; and a cleaning device for removing a toner remaining on a circumferential surface of the photoconductor drum, said cleaning device comprising:

a housing disposed above the photoconductor drum and having an opening portion open downward toward the circumferential surface of the photoconductor drum;

a cleaning blade disposed in the housing so as to be located in the opening portion downstream in a direction of rotation of the photoconductor drum; and a cleaning roller disposed in the housing so as to be located in the opening portion upstream from the cleaning blade in the direction of rotation of the photoconductor drum, and wherein, in the housing, toner outletting spiral means for letting out the toner recovered into the housing is disposed above the cleaning blade;

a partition wall is disposed between the cleaning blade and the toner outletting spiral means; and a toner movement space for moving the toner recovered into the housing is formed between a front end of the partition wall and a circumferential surface of the cleaning roller.

13. The image forming apparatus of claim 12, wherein when a rotation region of the toner outletting spiral means is viewed in a vertical direction, the partition wall extends out from a downstream end of the rotation region toward an upstream end of the rotation region in the direction of rotation of the photoconductor drum, and when the rotation region is viewed in the vertical direction, an effective length of shielding of the rotation region by the partition wall is 30% or more of a diameter of the rotation region.

14. The image forming apparatus of claim 13, wherein the front end of the partition wall is disposed nearly vertically below a center of rotation of the toner outletting spiral means.

15. The image forming apparatus of claim 12, wherein a horizontal distance at which the front end of the partition wall and the circumferential surface of the cleaning roller maximally approach each other is 2 mm or more.

16. The image forming apparatus of claim 12, wherein the circumferential surface of the cleaning roller rotationally moves in the same direction as the circumferential surface of the photoconductor drum at a site of pressurized contact between the circumferential surface of the cleaning roller and the circumferential surface of the photoconductor drum, a scraper is disposed within the housing, and a front end portion of the scraper is brought into pressurized contact with the circumferential surface of the cleaning roller at a position downstream from the site of pressurized contact between the circumferential surface of the cleaning roller and the circumferential surface of the photoconductor drum in a direction of rotation of the cleaning roller, with a front end of the scraper being directed in a direction opposite to the direction of rotation of the cleaning roller.

17. The image forming apparatus of claim 16, wherein the scraper is disposed so as to be capable of scraping off the toner deposited on the circumferential surface of the cleaning roller either to a gap between the cleaning roller and the toner outletting spiral means, or toward a rotation region of the toner outletting spiral means.

18. The image forming apparatus of claim 12, wherein a distance at which the circumferential surface of the cleaning roller and a rotation region of the toner outletting spiral means maximally approach each other is 3 mm or less.

19. The image forming apparatus of claim 12, wherein the cleaning roller functions as a polishing roller, because the circumferential surface of the cleaning roller makes pressurized contact with the circumferential surface of the photoconductor drum via the toner.

20. The image forming apparatus of claim 12, comprising:

an image forming apparatus body;

image forming means disposed in the body and including the photoconductor drum and the cleaning device;

document exposure/image reading means disposed within an upper end portion of the body and above the image forming means;

a paper stack space portion disposed in a region between the image forming means and the document exposure/image reading means in the body; and a paper transport passage extending in a vertical direction beside the photoconductor drum and adapted to guide fed paper to the paper stack space portion.

21. The image forming apparatus of claim 12, wherein the photoconductor drum comprises an a-Si-based photoconductor drum, and a peripheral speed of the cleaning roller is greater than a peripheral speed of the photoconductor drum.

22. The image forming apparatus of claim 12, wherein the toner comprises a magnetic toner.

23. An image forming apparatus comprising:

a photoconductor drum; and a cleaning device for removing a toner remaining on a circumferential surface of the photoconductor drum, said cleaning device comprising:

a housing disposed above the photoconductor drum and having an opening portion open downward toward the circumferential surface of the photoconductor drum;

a cleaning blade disposed in the housing so as to be located in the opening portion downstream in a direction of rotation of the photoconductor drum; and a cleaning roller disposed in the housing so as to be located in the opening portion upstream from the cleaning blade in the direction of rotation of the photoconductor drum, and wherein toner outletting spiral means for letting out the toner recovered into the housing is disposed above the cleaning blade in the housing;

a scraper is disposed within the housing;

a circumferential surface of the cleaning roller rotationally moves in the same direction as the circumferential surface of the photoconductor drum at a site of pressurized contact between the circumferential surface of the cleaning roller and the circumferential surface of the photoconductor drum;

a front end portion of the scraper is brought into pressurized contact with the circumferential surface of the cleaning roller at a position downstream from the site of pressurized contact between the circumferential surface of the cleaning roller and the circumferential surface of the photoconductor drum in a direction of rotation of the cleaning roller, with a front end of the scraper being directed in a direction opposite to the direction of rotation of the cleaning roller; and the scraper is disposed so as to be capable of scraping off the toner deposited on the circumferential surface of the cleaning roller either to a gap between the cleaning roller and the toner outletting spiral means, or toward a rotation region of the toner outletting spiral means.

24. The image forming apparatus of claim 23, wherein, in the housing, a partition wall is disposed between the cleaning blade and the toner outletting spiral means; and a toner movement space for moving the toner recovered into the housing is formed between a front end of the partition wall and the circumferential surface of the cleaning roller.

25. The image forming apparatus of claim 23, wherein the cleaning roller functions as a polishing roller, because the circumferential surface of the cleaning roller makes pressurized contact with the circumferential surface of the photoconductor drum via the toner.

26. The image forming apparatus of claim 23, comprising:

an image forming apparatus body;

image forming means disposed in the body and including the photoconductor drum and the cleaning device;

document exposure/image reading means disposed within an upper end portion of the body and above the image forming means;

a paper stack space portion disposed in a region between the image forming means and the document exposure/image reading means in the body; and a paper transport passage extending in a vertical direction beside the photoconductor drum and adapted to guide fed paper to the paper stack space portion.

27. The image forming apparatus of claim 23, wherein the photoconductor drum comprises an a-Si-based photoconductor drum, and a peripheral speed of the cleaning roller is greater than a peripheral speed of the photoconductor drum.

28. The image forming apparatus of claim 23, wherein the toner comprises a magnetic toner.

* * * * *